US011629505B2

(12) United States Patent
Braun

(10) Patent No.: US 11,629,505 B2
(45) Date of Patent: Apr. 18, 2023

(54) MOUNTING CLIP FOR THE FLOATING MOUNTING OF WALL AND CEILING PANELS

(71) Applicant: SWISS KRONO Tec AG, Lucerne (CH)

(72) Inventor: Roger Braun, Willisau (CH)

(73) Assignee: SWISS KRONO Tec AG, Lucerne (CH)

( * ) Notice: Subject to any disclaimer, the term of this patent is extended or adjusted under 35 U.S.C. 154(b) by 119 days.

(21) Appl. No.: 17/414,007

(22) PCT Filed: Dec. 19, 2019

(86) PCT No.: PCT/EP2019/086356

§ 371 (c)(1),
(2) Date: Jun. 15, 2021

(87) PCT Pub. No.: WO2020/127770

PCT Pub. Date: Jun. 25, 2020

(65) Prior Publication Data

US 2022/0042317 A1 Feb. 10, 2022

(30) Foreign Application Priority Data

Dec. 21, 2018 (EP) ..... 18215459

(51) Int. Cl.
*E04F 13/08* (2006.01)
*E04B 1/41* (2006.01)
(Continued)

(52) U.S. Cl.
CPC ..... *E04F 13/0846* (2013.01); *E04B 1/40* (2013.01); *E04F 13/0894* (2013.01);
(Continued)

(58) Field of Classification Search
CPC ... E04F 13/0846; E04F 13/0894; E04F 13/10; E04F 2201/0161; E04F 2201/043;
(Continued)

(56) References Cited

U.S. PATENT DOCUMENTS 4,011,635 A * 3/1977 Meyer ..... F16B 5/125 52/716.6
4,480,360 A * 11/1984 Brugman ..... E04B 9/26 24/295

(Continued)

FOREIGN PATENT DOCUMENTS

DE 19603399 A1 * 8/1997 ..... E04F 13/0826
DE 102005058105 B3 2/2007

(Continued)

OTHER PUBLICATIONS

International search report for patent application No. PCT/EP2019/086356 dated Mar. 11, 2020.
International preliminary report on patentability for application No. PCT/EP2019/086356 dated Jun. 16, 2021.

*Primary Examiner* — Rodney Mintz
(74) *Attorney, Agent, or Firm* — Bachman & LaPointe, P.C.

(57) ABSTRACT

A mounting clip (1) for the floating mounting of wall and ceiling panels consisting of composite wood materials, said panels being connected to one another without adhesive by corresponding locking profiles to form a wall or ceiling covering and being fastened to a substructure. The mounting clip has a base board (2), a receiving portion (4) formed in one piece with the base board and intended for engaging in a locking profile of a panel, wherein the receiving portion has a distancing piece (5) arranged as far as possible perpendicularly to the plane of the base board, and a contacting piece (6), which adjoins the distancing piece and is arranged as far as possible parallel to the plane of the base board, and a slot (8) is provided in the base board for
(Continued)

fastening the mounting clip to a fastening means on the substructure the slot can be at least 1.5-4 cm long and extend transversely with respect to the contacting piece.

17 Claims, 2 Drawing Sheets

(51) Int. Cl.
*E04F 13/10* (2006.01)
*E04B 1/38* (2006.01)

(52) U.S. Cl.
CPC ..... *E04F 13/10* (2013.01); *E04B 2001/405* (2013.01); *E04F 2201/0161* (2013.01); *E04F 2201/043* (2013.01)

(58) Field of Classification Search
CPC ..... E04F 2201/01; E04F 2201/023; E04F 2290/042; E04F 2290/043; E04F 2290/047; E04F 13/16; E04F 13/0826; E04F 13/0867; E04B 1/40; E04B 2001/405; E04B 9/0435; E04B 9/26
See application file for complete search history.

(56) References Cited

U.S. PATENT DOCUMENTS

| | | | | |
|---|---|---|---|---|
| 6,279,286 | B1 * | 8/2001 | Ichihashi | E04F 13/0826 52/489.1 |
| 6,315,489 | B1 * | 11/2001 | Watanabe | E04F 13/0846 248/220.21 |
| 9,476,194 | B1 * | 10/2016 | Hulka | E04B 1/40 |
| 10,041,258 | B2 * | 8/2018 | Pervan | E04F 15/10 |
| 10,060,139 | B2 * | 8/2018 | Pervan | B32B 3/30 |
| 10,428,532 | B2 * | 10/2019 | Smart | E04F 13/0894 |
| 2005/0102944 | A1 * | 5/2005 | Hikai | E04F 13/0846 52/511 |
| 2016/0168865 | A1 * | 6/2016 | Pervan | E04F 15/02016 52/309.1 |
| 2016/0237695 | A1 * | 8/2016 | Pervan | E04F 15/10 |
| 2018/0334809 | A1 * | 11/2018 | Smart | E04F 13/0846 |
| 2020/0392744 | A1 * | 12/2020 | Hatzinikolas | E04F 13/0846 |

FOREIGN PATENT DOCUMENTS

| | | | |
|---|---|---|---|
| DE | 202012100659 | U1 | 3/2012 |
| DE | 202012100565 | U1 | 4/2012 |
| EP | 1426520 | A1 | 6/2004 |
| EP | 3263792 | A1 | 1/2018 |

* cited by examiner

MOUNTING CLIP FOR THE FLOATING MOUNTING OF WALL AND CEILING PANELS

BACKGROUND OF THE INVENTION

The invention relates to a mounting clip for the floating mounting of wall and ceiling panels consisting of composite wood materials to a substructure and a wall and ceiling covering consisting of composite wood panels and mounting clips.

Wall and ceiling panels for fastening with a mounting clip are described for example in EP 3 263 792 A1. The document shows a mounting system with a rail designed with a hat-shaped cross-section for fastening to a substrate and a mounting clip that can be movably inserted in the rail by means of a rotary movement, the clip being slid onto a lower grooved flange of a first panel.

An advantage of this system is that it is already aligned with the characteristics of panels made from composite wood material, in particular a carrier board made from fibers or chips, and locking profiles on the side edges. Also, it allows an, as far as possible, floating mounting of the covering surface formed by the wall and ceiling panels. However, the system is complex to produce. Also, the mounting clips with the tabs for engaging the rail which protrude from the base board are prone to failing, since the tabs often bend and must be bent back during mounting in order to be able to insert them in the rail in a precise manner. Additionally, the system is inflexible, insofar as both the rail and the clips are specified as obligatory for the mounting of the composite wood panels and therefore a free selection of the substructure is not possible.

SUMMARY OF THE INVENTION

The object of the invention is to provide a mounting clip for the floating mounting of a wall or ceiling covering consisting of composite wood panels that can be connected by means of corresponding locking profiles to form a wall or ceiling covering, which can be produced particularly cost-effectively and allow a high degree of flexibility regarding the substructure to be selected. Furthermore, the object of the invention is to provide a corresponding wall and ceiling covering made from composite wood panels and mounting clips.

This invention is solved with a mounting clip having the features as disclosed herein and a wall and ceiling covering having the features also disclosed herein. Advantageous further embodiments of the invention are disclosed herein and set forth in the dependent claims. In this context, all features described are, each by itself or in any given combination, in principle subject matter of the invention, irrespective of their summary in the claims or their back reference.

The mounting clip according to the invention for the floating mounting of wall and ceiling panels made from composite wood materials, which are connected by means of corresponding locking profiles without adhesive to form a wall or ceiling covering and which are attached to a substructure, has a base board with a receiving portion that is formed in one piece with the base board for engaging in a locking profile of a panel, wherein the receiving portion has a distancing piece, which is perpendicular as far as possible to the plane of the base board, and has a contacting piece, which adjoins the distancing piece and is arranged as far as possible parallel to the plane of the base board, and a slot in the base board for fastening the mounting clip with a fastening means on the substructure, said slot being at least 1.5 to 4 cm long and extending transversely with respect to the contacting piece.

The receiving portion allows, jointly with the slot that is designed particularly long, a floating mounting as far as possible of the wall or ceiling covering surface (hereinafter called covering surface) generated from the composite wood panels (hereinafter also called merely panels). With swelling and shrinking movements of the panels, such panels can, on the one hand, slide forward and backward in the receiving portion in a panel longitudinal axis direction, whereas, on the other hand, a movement transverse to the longitudinal axis direction of the panels is enabled by the slot fastening of the clip. This means that, with a movement of the panel surface transversely to the longitudinal axis direction of the panels, the individual clips, which are fastened with a fastening means to the substructure, move along the substructure, and move along transversely to the longitudinal axis direction of the panel, i.e., in the longitudinal axis direction of the mounting clip (hereinafter also called merely a clip).

Especially the particularly long design of the slot with 1.5 cm to 4 cm allows even large covering surfaces the necessary freedom of movement in the direction transverse to the panel longitudinal axis.

Fastening means in conjunction with the invention shall be understood to be fastening means that have a pin-like base body with a fastening means head the cross-section of which is larger. This can for example be appropriate nails, but are preferably screws. In this context, the mounting clips are advantageously fastened to the substructure using countersunk screws.

A substructure within the context of the invention shall be understood to be a system of strut members, free-standing or arranged in front of an existing wall/ceiling.

Locking profiles shall be understood to be profiles on the side edges of the panels, which allow the connection of two panels, wherein the locking profiles to be connected are formed with shapes corresponding to one another, and the profiles connected without adhesive prevent both a height offset of the panel surfaces of the connected panels and a formation of gaps between the connected panels. Locking profiles are in particular rotary profiles, swivel profiles, rotary swivel profiles or push button profiles (vertical locking profiles).

Composite wood panels are in particular wall or ceiling panels with a carrier board consisting of composite wood material, in particular of a fiber board such as MDF, HDF, or a plywood board, and a surface coating. The surface coating is preferably decorative and has at least a color decoration, but it can supplementally also comprise a protective layer. The decorative coating can in particular be designed as a varnish coating or a decorative paper with or without overlay.

According to a further embodiment of the invention, a bead extending around the slot is designed on the edge of the slot in the base board. The bead fulfills several functions. On the one hand, it is a reinforcement for the slot. On the other hand, it forms a support for the fastening means or respectively for the head of the fastening means, in particular a support for the head of a countersunk screw. As the most important and surprising function, however, the bead prevents the pressure from the fastening means on the clip from becoming so great that such clip can no longer perform any movement along the substructure. Thus, the bead buffers the pressure of the fastening means on the mounting clip, but it also still ensures a secure fastening of the clip to the substructure. Hereby, the movability of the clip against the substructure overall is improved without restricting the secureness when the clip is attached.

Particularly with soft substructures such as substructures consisting of wood, the bead additionally prevents the fastening means from bending the edges of the slot into the substructure, such that the mounting clip claws into the substructure and prevents a movement of the mounting clip. For a particularly cost effective and easy production, the slot is particularly preferably designed as a die-cut hole. In this context, the die-cut hole and the bead are preferably produced in a single work step.

Another further embodiment of the invention provides that the receiving portion has only a thickness between 0.2 mm and 0.6 mm, particularly preferably 0.4 mm+/−0.15 mm. The particular advantage of the small thickness of the receiving portion lies in its universal usability for a plurality of different locking profiles of the type in question. Locking profiles are designed particularly compactly due to their functions of preventing both a height offset and a gap between two panels without adhesive, and have only small spaces in between. The receiving portion with the particularly small thickness, however, allows the use of the mounting clips for a plurality of common locking profiles. The receiving portion and the base board are preferably formed in one piece, i.e., from one part, and not assembled from two previously separate parts.

The mounting clip additionally has the following dimensions, which further improve the universal usability for composite wood panels with locking profiles: thickness of base board 0.2 mm to 0.6 mm, particularly 0.4 mm+/−0.15 mm, width of base board 3.10 cm to 3.40 mm, length of base board 5.10 cm to 7 cm, particularly 5.15 cm+/−0.3 cm, width of receiving portion 1.64 cm+/−0.25 cm, height of distancing piece 0.5 cm+/−0.1 cm, height of contacting piece 0.5 cm+/−0.1 cm.

According to a further embodiment of the invention, linear beads are arranged in the base board which extend in the base board longitudinal direction. Especially with a particularly thin design of the base board, such board tends to bend during mounting or when mounted due to the movements of the panels or respectively to lift off the substructure in portions. Hereby, the mounting clips can for example also jam, so that they are hindered in their movements transversely to the panel longitudinal axis. The beads arranged in the longitudinal axis direction cause an increase in stability of the mounting clips. Hereby, the receiving portion is held in an exact position, too, so that such receiving portion cannot slide off the lower grooved flange of the panel. Particularly preferably, the beads are arranged on the right and left next to the receiving portion. Whereas the receiving portion is typically arranged in a centered manner in relation to the width of the base board, the beads are provided accordingly in the edge region, wherein they are preferably moved slightly inwards in relation to the outer edge of the base board and do not form the outer edge. Linear is to be understood to mean straight, i.e., without an arcuate form, in the longitudinal axis direction of the mounting clip.

A particularly high stability of the base board in a longitudinal axis direction of the mounting clip is particularly preferably achieved by the beads extending across at least half the length of the base board, preferably at least across two thirds of the length of the base board. Hereby, it is ensured that, even with a significant displacement of the mounting clip inside the slot, an adequate stability of the clip against lifting off the substructure and potentially a slipping out of the receiving portion from the lower grooved flange continue to be given.

According to a further embodiment of the invention, it is provided that the bead extending circumferentially around the slot and/or the linear beads form recesses on the underside of the base board, i.e., on the side of the base board which is in abutment with the substructure, and form elevations on the top side of the base board, i.e., on the side against which the panel is in abutment. Hereby, all functions of the linear beads as well as of the beads extending circumferentially around the slot can be completely fulfilled, and the clip still has a small overall thickness. It must be noted that the beads in particular have an elevation in the region between 1 and 2 mm, particularly preferably of 1.4 mm+/−0.2 mm.

According to a further embodiment of the invention, it is provided that the receiving portion is designed as a die-cut and twice-bent tongue. I.e., the receiving portion has a free end in the region of the contacting piece. The contacting piece is connected in one piece to the distancing piece on the end opposite the free end, whereas the distancing piece is connected in one piece with the base board on the end opposite the contacting piece. Base board and receiving portion are designed in one piece, i.e., from one workpiece. The design as a die-cut tongue allows a particularly precise design of the receiving portion, whereby the mounting clip can be produced particularly cost-effectively, especially as a mass product.

In order to improve the stability of the mounted panel at the contacting portion and in particular also the sliding of the panel at the contacting portion, it is provided according to a further embodiment of the invention that the receiving portion corresponds to at least half the base board width, advantageously at least two thirds of the base board width.

In principle, the mounting clip can be formed from different materials. For example, a mounting clip consisting of plastic or even of a composite material such as a WPC would be conceivable. Particularly preferably, the mounting clip is, however, formed from a metal, in particular a sheet, preferably a galvanized sheet. Hereby, the mounting clip can be produced particularly as a mass product and extremely cost-effectively, wherein all technical characteristics, in particular also the technical variation of the preferred embodiment, are easy to implement.

Furthermore, the invention is solved by a wall and ceiling covering made from composite wood panels and mounting clips of the aforementioned type, wherein a mounting clip with its receiving portion is in abutment on a lower grooved flange of a locking profile of a first composite wood panel and is fastened with fastening means protruding through a slot in the mounting clip to a substructure, wherein the panel is movably in abutment with the receiving portion and the mounting clip is fastened to the substructure in a movable manner along its slot.

The wall and ceiling covering according to the invention represents an as far as possible floatingly mounted covering consisting of modern composite wood panels, which form a covering surface by means of locking profiles that are connected to one another without adhesive. In this context, the composite wood panels particularly preferably comprise a carrier board consisting of plywood or fiber board such as an HDF or MDF or a sandwich board made from plywood and fiber board. The carrier board typically comprises an appropriate decorative coating and is formed with locking profiles on the side edges, which establish a connection without adhesive between the panels when connected, which allows neither offsets in height nor gaps between the panels. As decorative coatings, all coatings known from the composite wood materials region are conceivable. Thus, they can be for example synthetic resin coatings with a decorative paper that is impregnated with synthetic resin and compressed. Here, for example protective coatings such as an overlay can also be arranged on the decorative paper. Also, varnish coatings can be provided as decorative coatings, which comprise a color decoration and potentially a further protective layer, for example based on a varnish, on top of the color decoration.

The mounting clip increases the flexibility of the substructure, since, due to the simple and standardized direct mounting of the clip using a fastening means on any given substructure, for example a wood lattice, a metal strut system, or even directly on a room delimiting wall, the wall and ceiling covering can be used easily and uncomplicatedly in a plurality of different rooms without special preparation of the walls and ceilings.

According to a further embodiment of the invention, it is provided that the receiving portion is arranged between a lower grooved flange of a first panel and a contacting edge of a second panel, which is connected to the first panel via the locking profiles, wherein the lower grooved flange presses against the contacting portion of the mounting clip and displaces the mounting clip when the panels swell, and the second panel remains connected to the first panel via the locking profiles and the mounting clip is moved in the opposite direction via the contacting edge on the locking profile of the second panel when the panels shrink. This movement of the mounting clip in both directions, i.e., both with swelling and shrinking movements, which can for example also take place alternatingly, ensures that the receiving portion is in permanent abutment with the contacting portion and even during or respectively after the corresponding movements, is still in abutment with the lower grooved flange, and that the first panel cannot disconnect from the mounting clip because of movements.

A particularly preferred further embodiment of the invention provides that the composite wood panels are designed as acoustic panels. Acoustic panels have a surface into which the sound waves from the room can penetrate. Thus, acoustic panels can have recesses such as slits, holes, microperforation, or similar. The sound waves which enter the acoustic panel through the recesses or respectively run through the acoustic panel are absorbed or respectively reflected accordingly inside the acoustic panel or respectively in the wall/ceiling/substrate behind it. For a better absorption, the acoustic panel can preferably comprise an additional acoustic absorber on its back side. The absorber can alternatively also be part of the substructure.

With an embodiment of the composite wood panels with absorbers on the back side, the distancing piece of the receiving portion is preferably lengthened at least by the thickness of the absorber in order to ensure the continued secure fastening of the composite wood panels.

A particularly preferred embodiment of the wall and ceiling covering additionally provides that, before fastening the mounting clips and the composite wood panels, a non-woven fabric is stretched onto the substructure, for example nailed on. Hereby, on the one hand, an at least partial uncoupling of the wall or ceiling covering from the substructure is created, on the other hand, the non-woven fabric acts as a trickle protection, for example for strut systems that are filled with insulating material, and finally, the non-woven fabric is a privacy protection for acoustic panels. Accordingly, in particular a black colored non-woven fabric is arranged.

A particular embodiment of the invention provides that the wall and ceiling covering is designed with fire protection for which for example the panels are designed as fire protected panels. The panels fulfil fire protection class BS2 D0 according to EN 13501. For this purpose, the panels comprise in particular a fire protected carrier board. The panel receives the fire protection among other things from a carrier board made from composite wood material, in particular a fiber board which has a high density, for example in the range of 850 kg/m$^3$ to 950 kg/m$^3$. A further component for fire protection for panels with a fiber board as a carrier board is a flame retardant that is contained in the carrier board. The flame retardant can be mixed with the fibers before a fiber cake is produced. For example, it has been found that, with a fiber board glued with melamine formaldehyde resin, which comprises for example the density stated above, is between 7 mm and 9 mm thick, and has a glue content between 15% and 30%, for example as much as between 9% and 17% (solid material in relation to atro fibers) of a flame retardant will be sufficient in order to achieve the specified fire protection class. For fiber boards glued with PMDI/EMDI with the aforementioned density and thickness, a significantly lower glue content of between 5 and 8% (solid material in relation to atro fibers) is sufficient, though, in order to achieve the specified fire protection class with a flame retardant content between 12% and 21% (solid material in relation to atro fibers). Carrier boards designed in such a way are usable for both standard wall and ceiling panels of the aforementioned type (including with coating) and for the aforementioned acoustic panels (including with coating) and fulfil the requirements for the aforementioned fire protection class.

Although some aspects were described in conjunction with the mounting clip, it is understood that these aspects also represent a description of a corresponding production and/or mounting method or respectively of the wall and ceiling covering, so that a block or a component of the mounting clip is also to be understood as a corresponding method step or as a feature of a method step or respectively as a feature of the wall and ceiling covering. Analogously, aspects that were described in conjunction with the wall and ceiling covering also represent a description of a production and/or mounting method or respectively of the mounting clip. Additionally, reference is made to the explanations regarding the mounting clip with regard to the further features of the wall and ceiling covering and with regard to corresponding definitions of features.

BRIEF DESCRIPTION OF THE DRAWINGS

In the following, the invention is described in greater detail based on an exemplary embodiment. Therein.

DETAILED DESCRIPTION

Figure 2:
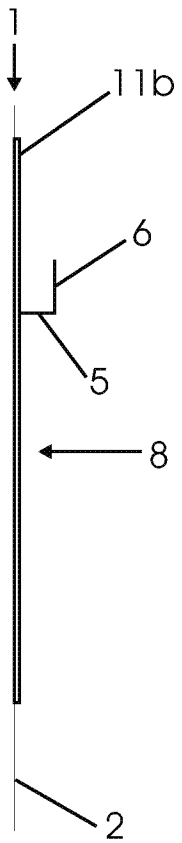
FIG. 2 shows the embodiment of the mounting clip according to the invention from FIG. 1 schematically in a cross-section.
Figure 1:
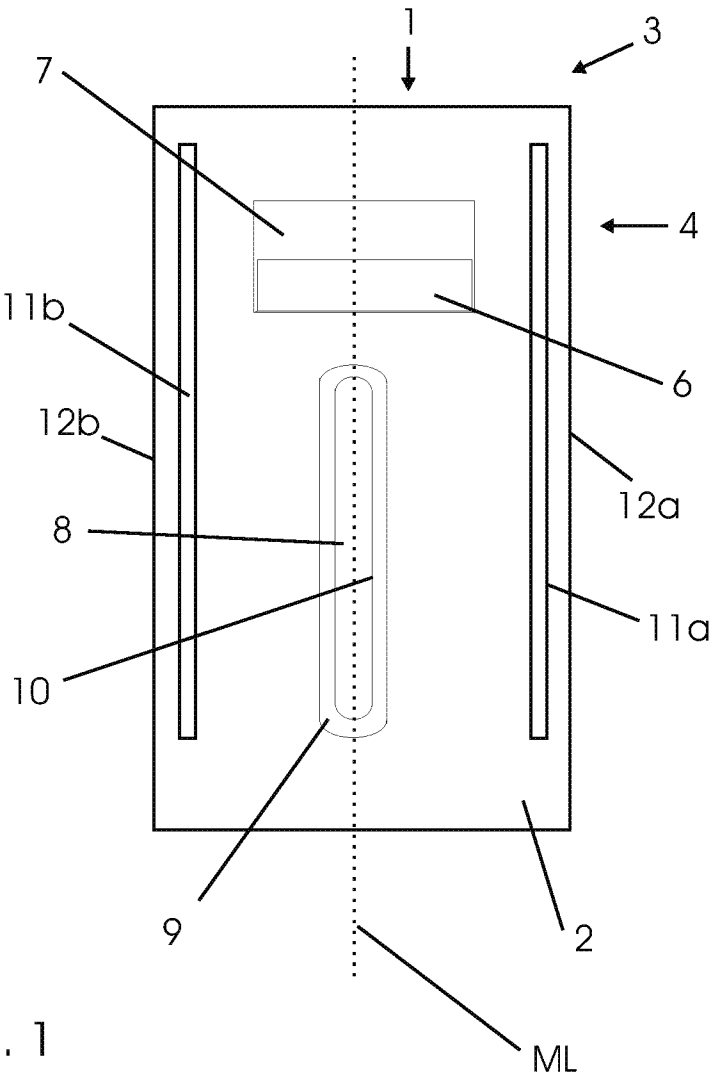
FIG. 1 shows an embodiment of the mounting clip according to the invention schematically in a view.

FIGS. 1 and 2 show a first embodiment of the mounting clip 1 according to the invention with a base board 2. The base board 2 is rectangular and approx. 3.3 cm wide, approx. 5.2 cm long, and approx. 0.5 mm thick. Starting from the top edge 3 of the mounting clip 1, the receiving portion 4 is arranged in the first third of the base board 2. The receiving portion 4 is designed as a die-cut tongue. It has a distancing piece 5 (see FIG. 2) and a contacting piece 6. In the region of the receiving portion 4, there is an opening 7 in the base board 2. The opening 7 was created by the die-cutting of the receiving portion 4. The width of the receiving portion 4 corresponds to approx. 50% of the width of the mounting clip 1. The receiving portion 4 also has a thickness of approximately 0.5 mm.

Starting from the top edge 3 below the receiving portion 4 and along the center longitudinal axis ML of the mounting clip 1, a slot 8 extends in a longitudinal axis direction L (represented by an arrow) of the mounting clip 1. The slot 8 is 2.5 cm long and has a diameter of 4 mm. A bead 9 extends around the slot 8 for reinforcement of the edge 10 of the slot 8. The bead is approx. 4.5 mm wide here. It is expressly pointed out that the individual features and parts in the FIGS. 1-3 are not shown to scale in relation to one another.

For a particularly stable embodiment of the mounting clip 1, such clip additionally has two linear beads 11*a*, 11*b*, which are arranged in the region of the side edges 12*a*, 12*b* albeit at a distance from the side edges 12*a*, 12*b*. The linear beads 11*a*, 11*b* are thus arranged on the right and left of the receiving portion 4 and the slot 8. The linear beads 11*a*, 11*b* are approx. 3.5 mm wide and extend across three quarters of the length of the mounting clip 1. The linear beads 11*a*, 11*b* are arranged in parallel with one another. The height of the beads 9, 11*a*, 11*b* is approx. 1.5 mm.

Figure 3:
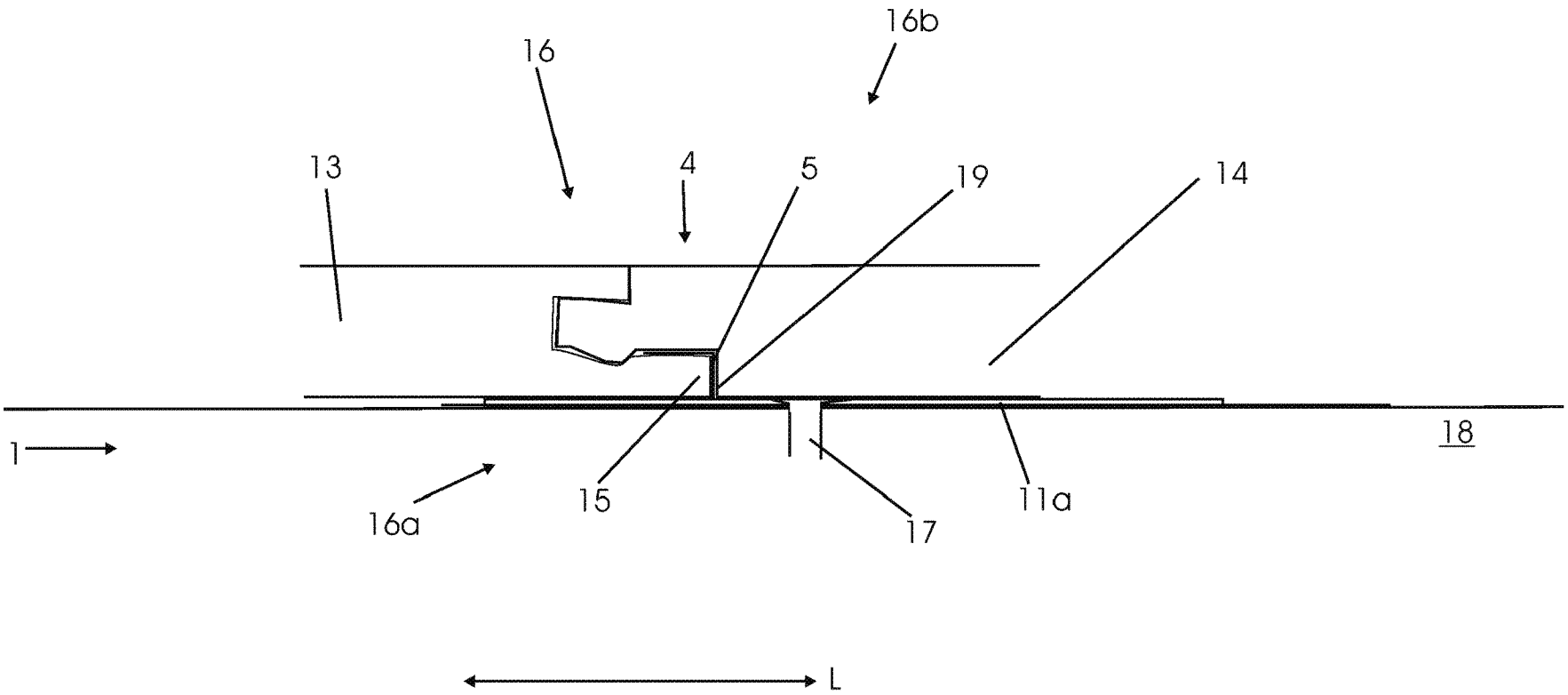
FIG. 3 shows a detail of a ceiling or wall covering with the mounting clip 1 in an installation situation with a first and a second composite wood panel schematically in a cross-section.

FIG. 3 shows a detail of a ceiling or wall covering with the mounting clip 1 in an installation situation with a first and a second composite wood panel 13, 14 schematically in a cross-section. The composite wood panels 13, 14 are an HDF with a decorative coating, but can also be a coated plywood board, MDF, or similar as an alternative. The mounting clip 1 is mounted with its receiving portion 4 on a lower grooved flange 15 of a first part 16*a* of a locking profile 16. The second part 16*b* of the locking profile 16 corresponds to the first part 16*a*. The corresponding parts 16*a*, 16*b* of the locking profile 16 are connected to one another without adhesive and prevent the forming of a gap or a height offset between the panels 13, 14.

The first panel 13 and the second panel 14 rest on the linear beads 11*a*, 11*b* of the mounting clip 1. The mounting clip 1 is fastened by means of a screw 17 to the substructure 18. The screw 17 is designed as a countersunk screw here, it is seated on the bead 9 extending around the slot 8, and seals flush with it.

With a swelling movement of the panels 13, the lower grooved flange 15 pushes against the receiving portion 4, in particular against the distancing piece 5, and displaces the mounting clip 1 in a longitudinal axis direction L of the mounting clip 1, i.e., transversely to the longitudinal axis direction (not shown here) of the panels 13, 14. Thereby the mounting clip 1 slides along the fixed screw 17 with its slot 8.

With a shrinking movement, the panels 13, 14 contract. For the mounting clip 1 not to remain in its position and potentially slide down off the lower grooved flange 15 of the first panel, the contacting portion 19 in the second part 16*b* of the locking profile 16 is designed in such a way as to come into contact with the mounting clip 1 when the panels 13, 14 move in a shrinking direction and displace it. With the shrinking and swelling movements, the panel surface as a whole moves due to the locking profiles 16 between the panels 13, 14.

The invention claimed is:

1. A mounting clip for floating mounting of wall and ceiling panels (13, 14) made from composite wood materials, which are connected to one another without adhesive using corresponding interlocking locking profiles (16) to form a wall or ceiling covering and are fastened to a substructure (18) with the mounting clip having a base board (2) having a length a width, a receiving portion (4) integrally formed as a single piece with the base board (2) to engage a respective said interlocking locking profile (16) of a respective said panel (13, 14), wherein the receiving portion (4) has a distancing piece (5), which is arranged substantially perpendicular to a plane of the base board (2) and a contacting piece (6), which adjoins the distancing piece (5) and is arranged substantially parallel to the plane of the base board (2), and a slot (8) in the base board (2) configured to fasten the mounting clip (1) with a fastening means to the substructure (18), wherein the slot (8) is at least 1.5 cm (0.59 inches)-4 cm (1.57 inches) long and extends in a longitudinal axis direction (L) of the mounting clip and transversely to the contacting piece (6), and a bead (9) that extends around the slot (8), and alleviates pressure of the fastening means on the mounting clip, is formed on an edge of the slot (8) in the base board (2).

2. The mounting clip according to claim 1, wherein the slot (8) is designed as a die-cut hole.

3. The mounting clip according to claim 1, wherein the receiving portion (4) is designed as a die-cut and twice bent tongue.

4. The mounting clip according to claim 1, wherein the receiving portion (4) has a thickness of between 0.2 mm and 0.6 mm.

5. The mounting clip according to claim 1, wherein a width of the receiving portion (4) corresponds at least to half the base board width.

6. The mounting clip according to claim 1, wherein, in the base board (2), linear beads (11*a*, 11*b*) extending in the longitudinal direction (L) of the base board (2) are present.

7. The mounting clip according to claim 6, wherein the beads (9, 11*a*, 11*b*) are arranged on the right and left next to the receiving portion (4).

8. The mounting clip according to claim 6, wherein at least one of (i) the bead (9) extending around the slot (8) or (ii) the linear beads (11*a*, 11*b*) form recesses on an underside of the base board (2) and elevations on a top side of the base boards (2).

9. The mounting clip according to claim 6, wherein the linear beads (11*a*, 11*b*) extend across at least half the length of the base board (2).

10. The mounting clip according to claim 9, wherein the linear beads (11*a*, 11*b*) extend across at least two thirds of the length of the base board.

11. The mounting clip according to claim 1, wherein the mounting clip (1) is formed from metal.

12. The mounting clip according to claim 11, wherein the metal is sheet metal.

13. The mounting clip according to claim 11, wherein the metal is galvanized sheet metal.

14. A wall and ceiling covering made from composite wood panels and mounting clips (1) according to claim 1, wherein a respective said mounting clip (1) abuts with the receiving portion (4) on a lower grooved flange (15) of a respective said locking profile (16) of a first panel (13) and is fastened to the substructure (18) with a respective said fastening means protruding through the slot (8), wherein the first panel (13) is movably in abutment with the receiving portion (4) and the mounting clip (1) is fastened movably along the slot (8) to the substructure (18).

15. The wall and ceiling covering according to claim 14, wherein the distancing piece (5) of the respective mounting clip (1) is arranged between the lower grooved flange (15) of the first panel (13) and a contacting portion (19) of a second panel (14), which is connected to the first panel (13) via the locking profiles (16), such that the lower grooved flange (15) of the first panel (13) pushes against the distancing piece (5) and displaces the mounting clip (1) when the panels (13, 14) swell, and the second panel (14) remains connected without gaps and offsets to the first panel (13) via the locking profiles (16) and the mounting clip (1) is moved in the opposite direction via the contacting portion (19) on the locking profile (16) of the second panel (14) when the panels (13, 14) shrink.

16. The wall and ceiling covering according to claim 14, wherein the wall and ceiling panels are composite wood panels.

17. The wall and sealing covering according to claim 16, wherein the composite wood panels are panels (13, 14) with a carrier board made from plywood, fiber board or plywood and fiber board.

* * * * *